US010993521B2

(12) United States Patent
Diard

(10) Patent No.: US 10,993,521 B2
(45) Date of Patent: May 4, 2021

(54) SPORT BAG WITH EXTERNAL ARMATURE

(71) Applicant: BABOLAT VS, Lyons (FR)

(72) Inventor: Guillaume Diard, Poisy (FR)

(73) Assignee: BABOLAT VS, Lyons (FR)

( * ) Notice: Subject to any disclaimer, the term of this patent is extended or adjusted under 35 U.S.C. 154(b) by 0 days.

(21) Appl. No.: 16/434,752

(22) Filed: Jun. 7, 2019

(65) Prior Publication Data

US 2019/0374011 A1 Dec. 12, 2019

(30) Foreign Application Priority Data

Jun. 9, 2018 (FR) ..... 1855051

(51) Int. Cl.
*A45F 3/08* (2006.01)

(52) U.S. Cl.
CPC ..... *A45F 3/08* (2013.01)

(58) Field of Classification Search
CPC ..... A45F 3/08; A45F 4/02; A45F 3/10; A45F 2004/026; A45F 2003/003; A45F 2004/006
See application file for complete search history.

(56) References Cited

U.S. PATENT DOCUMENTS 3,292,830 A 12/1966 Mack
3,865,392 A * 2/1975 Hartway ..... B62B 1/125 280/35
4,593,841 A * 6/1986 Lange ..... A45C 9/00 224/153
4,659,142 A * 4/1987 Kuchinsky, Jr. ..... A47C 1/143 280/47.25
5,447,261 A * 9/1995 Mitomi ..... A45C 5/14 190/110
7,537,143 B1 * 5/2009 Collier ..... A45F 3/08 224/633
8,038,042 B2 * 10/2011 Bartel ..... A45C 5/14 224/153
10,470,552 B2 * 11/2019 Ripepi ..... A45F 3/10
10,647,340 B2 * 5/2020 Kinnee ..... B62B 5/085
2001/0017307 A1 * 8/2001 Bentzen ..... A45F 3/08 224/634
2002/0100778 A1 8/2002 McUmber

OTHER PUBLICATIONS

French Search Report, FR1855051, dated Jan. 25, 2019.

* cited by examiner

*Primary Examiner* — Adam J Waggenspack
(74) *Attorney, Agent, or Firm* — Nixon & Vanderhye

(57) ABSTRACT

This sport bag comprises a flexible enclosure (2) delimiting an equipment storage space, as well as a rigid armature (4), attached to the enclosure, arranged outside the enclosure and provided to rest on a support surface (S) in two different positions, namely a first position, in which the armature (4) rests on the support surface (S) by at least three first bearing points, and a second position, in which the armature (4) rests on the bearing surface by at least three second bearing points. The three second bearing points are not all the same as the three first bearing points.

15 Claims, 4 Drawing Sheets

SPORT BAG WITH EXTERNAL ARMATURE

BACKGROUND OF THE INVENTION

Field of the Invention

The present invention relates to a sport bag, also called sports bag.

Description of the Related Art

In many sports, practicing an athletic activity requires using one or several accessories, which must be brought to the location of this practice, used on this occasion, then taken away and stored until the next practice. To that end, it is known to use a sport bag, most often formed by an enclosure made from a flexible synthetic material, which is easily transportable. For example, for tennis, it is known to store a player's racket(s) and balls in a sport bag and to bring this equipment to the court with this bag. The same approach is known for other racket sports, in particular badminton or paddle ball, as well as for other sports, such as climbing, where boot liners and a harness are commonly carried in a bag to the base of a route.

These bags tend to become dirty quickly, since the places where some sports are practiced are sometimes wet or muddy. This may be the case for a dirt tennis court after rain or an access path to a climbing route. As a result, athletes' bags are sometimes dirty and not very presentable, which is not good in terms of hygiene or image, in particular for professionals, or in pedagogical terms, regarding respect for the equipment.

BRIEF SUMMARY OF THE INVENTION

The invention more particularly aims to resolve these drawbacks by proposing a new sport bag that is less inclined to become dirty than the known bags, while remaining easy to manipulate.

To that end, the invention relates to a sport bag comprising a flexible enclosure delimiting an equipment storage space. This sport bag comprises a rigid armature, attached to the enclosure, arranged outside the enclosure and provided to rest on a support surface in two different positions, namely a first position, in which the armature rests on the support surface by at least three first bearing points, and a second position, in which the armature rests on the bearing surface by at least three second bearing points, while the three second bearing points are not all the same as the three first bearing points.

Owing to the invention, the external armature makes it possible to set the bag on a support surface, such as the ground, in one of the two positions of the armature, while protecting the flexible enclosure from grime, while the access to the storage space is compatible with the wishes of the athlete. Indeed, the three bearing points used in the two positions of the armature rest on the support surface, which makes it possible to keep the flexible enclosure at a distance from this surface, while imparting a good stability to the bag in these two positions. For example, for a tennis bag, the player can place a racket in the storage space from the top, when the armature is in its first position, by opening a zipper over several centimeters. Furthermore, when the armature is in its second position, the contents of the bag can be accessed by completely opening the zipper, such that a flap of the flexible enclosure can be moved away, like a suitcase.

In this second position of the armature, access to the storage space is made easier, which allows the player to store his equipment with care.

According to other advantageous, but optional aspects of the invention, such a sport bag may incorporate one or more of the following features, considered in any technically allowable combination:

- in at least its first position, and preferably both of its positions, the armature keeps the flexible enclosure at a distance from the support surface;
- the armature comprises two lateral uprights, each positioned along one side of the enclosure and which each end with a fork, from which extend, on the one hand, a tab connected to a bearing pad on the support surface and, on the other hand, a foot intended to bear on the support surface;
- the two tabs that extend from the two forks are connected to a same pad that forms one of the three first bearing points;
- free ends of the feet form some of the first and/or second bearing points;
- the sport bag is equipped with straps allowing a user to carry it on his back, while the feet extend, from the forks, on the same side of the uprights as the straps;
- in the first position of the armature, the pad extends below the flexible enclosure, at a distance therefrom;
- the armature comprises a bridge that connects the lateral uprights, opposite their respective forks, and which forms one of the three second bearing points;
- at least one of the three second bearing points, preferably two of them, is or are the same as one or some of the three first bearing points;
- the armature is made from synthetic material, in particular thermoplastic, metal, composite material or wood;
- the armature is manufactured by assembly, at the pad and the bridge, of two parts respectively forming its left and right sides;
- in a variant, the armature (4) is monobloc.

BRIEF DESCRIPTION OF THE DRAWINGS

The invention will be better understood and other advantages thereof will appear more clearly in light of the following description, provided solely as an example and done in reference to the appended drawings, in which.

DETAILED DESCRIPTION OF THE PREFERRED EMBODIMENTS

Figure 1:
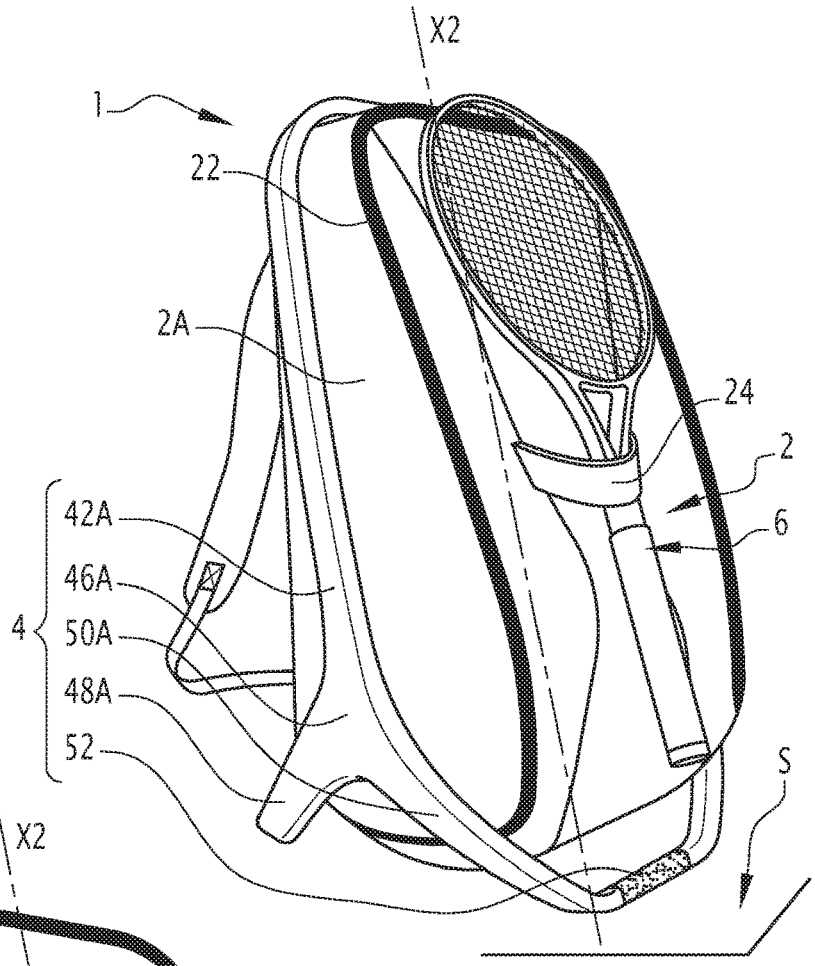
FIG. 1 is a perspective view of a sport bag according to the invention resting on the ground, with its armature in a first position and while it is bearing a tennis racket on the outside.

The bag 1 shown in the figures is provided to contain the equipment of a tennis player, such as his racket(s), balls, wristbands, spare stringing, hygiene products, shoes, jersey, etc.

This bag 1 comprises a flexible enclosure 2 preferably made from synthetic material, for example polyamide or Nylon (registered trademark), and which defines a storage space for this equipment, this space being able to be single-compartment or multi-compartment. The flexible enclosure 2 can be formed by a fabric, a net, a calendered nonwoven membrane or any other suitable material. The flexible enclosure 2 is equipped with a zipper 22 that can be more or less open to access the storage space.

The flexible enclosure 2 extends along the longitudinal axis X2, which is parallel to the largest dimension of this enclosure and which passes through the center of a section of this enclosure perpendicular to this dimension.

Hereinafter, the sides of the bag 1 are identified according to its depiction in FIGS. 1 to 4, where the axis X2 is globally vertical. Globally vertical means that this axis is vertical to within 30°. In this configuration, the top of the bag faces the top of these figures and the bottom of the bag faces the bottom of these figures. The left side of the bag 1 is visible in FIGS. 1 to 3 and 5, while its right side is visible in FIG. 4. The front of the bag 1 is the side equipped with straps visible in FIG. 3. The back of the bag 1 is the side visible in FIGS. 1 and 2. The identification of the sides of the flexible enclosure 2 is done in the same way.

The bag 1 also comprises an external armature 4 secured to the flexible enclosure 2 on the outside thereof. In practice, the flexible enclosure 2 and the armature 4 can be welded or glued together. In a variant, they can be secured by a reversible system of the loop and hook type, known under the Velcro trademark, or snapped together. Any other means of securing the parts 2 and 4, whether permanent or reversible, can be considered.

The armature is made from synthetic material, preferably thermosetting, such as polyethylene (PET) or polyamide (PA). The synthetic material used to produce the armature 4 can be extruded, compressed, injected, molded, thermoformed or 3D-printed. In a variant, the armature 4 can be made from metal, for example aluminum, or from a composite material with a synthetic matrix and reinforcing fibers. It can also be made from wood.

The armature 4 comprises two lateral uprights, namely a left lateral upright 42A that adjoins the left side 2A of the flexible enclosure 2, from the outside, and a right lateral upright 42B that adjoins the right side 2B of the flexible enclosure 2, also from the outside. These two uprights are connected by a bridge 44 that extends above the flexible enclosure in the configuration shown in the figures.

The left lateral upright 42A comprises a fork 46A at which it splits in two, opposite the bridge 44, between a foot 48A and a tab 50A, which define an angle A4 between them of between 80 and 110, preferably of about 100°. The foot 48A is provided in order, in the position shown in FIGS. 1 to 4, to rest on a support surface, in particular the ground, by its free end 48A2 opposite the fork 46A. The tab 50A extends, moving away from the fork 46A and toward the upright 42B, up to a tab 52 that is provided to bear on the ground, in the configuration of FIGS. 1 to 4.

The right lateral upright 42B also comprises a fork 46B at which it splits in two, opposite the bridge 44, between a foot 48B and a tab 50B. The foot 48B is provided in order, in the position shown in FIGS. 1 to 4, to rest on a support surface, in particular the ground, by its free end 48B2 opposite the fork 46B. The tab 50B extends, moving away from the fork 46B and toward the upright 42A, up to the tab 52.

The lateral uprights are preferably parallel to the axis X2.

Preferably, the armature 4 is symmetrical to a plane P4 that is equidistant relative to the forks 46A and 46B, passing between these forks.

Figure 6:
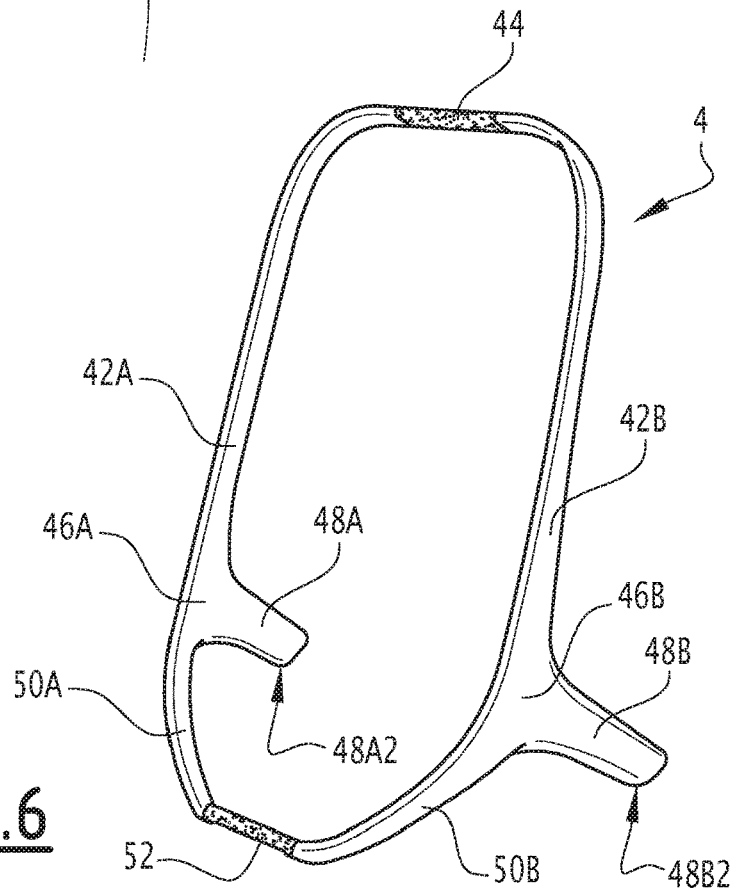
FIG. 6 is a perspective view of the armature of the bag of FIGS. 1 to 4.
Figure 7:
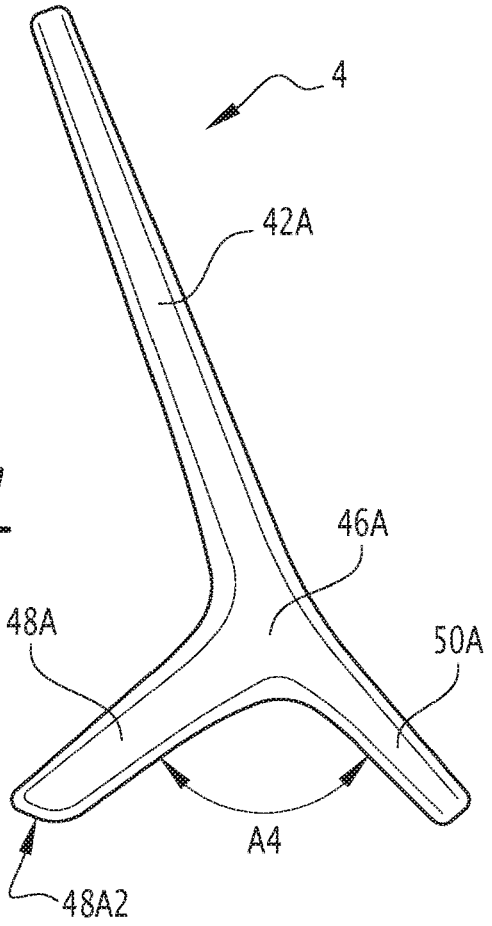
FIG. 7 is a side view of the armature.
Figure 8:
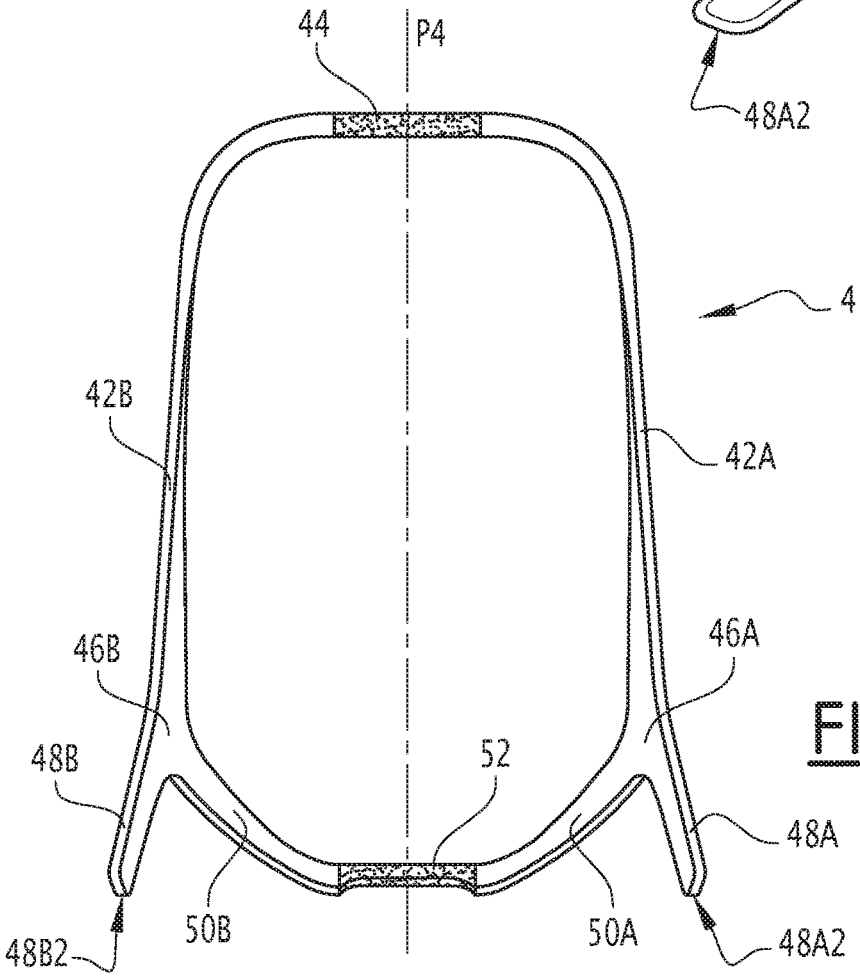
FIG. 8 is a front view of the armature, from the front.

The uprights 42A and 42B, the bridge 44, the tabs 50A and 50B and the pad 52 form a closed ring, visible in FIGS. 6 and 8, within which the flexible enclosure 2 is mounted.

The armature is manufactured by the assembly of two parts respectively forming its left and right sides. The assembly, between a left part comprising the portions 42A, 46A, 48A and 50A and a right part comprising the portions 42B, 46B, 48B and 50B, takes place at the bridge 44 and the pad 52. This manufacturing method allows easy transport of the left and right parts before assembly.

In a variant, the armature 4 can be monobloc, in particular when it is made by 3D-printing.

In the position shown in FIGS. 1 to 4, the free ends 48A2 and 48B2 and the pad 52 form three bearing points of the armature 4, therefore of the sport bag 1, on the support surface S. This first position is stable because the number of bearing points of the armature 4 on the surface S is greater than or equal to 3.

In this position, the pad 52 is arranged below the flexible enclosure 2, at a distance therefrom. The enclosure is therefore moved away from the surface S and does not risk becoming dirty, even if the surface S is muddy.

In this position of the bag 1 and the armature 4, it is possible for the player to access the internal storage space of the enclosure 2, by opening the zipper 22 over a relatively small length. This for example allows him to place a racket or ball in this storage space.

Figure 2:
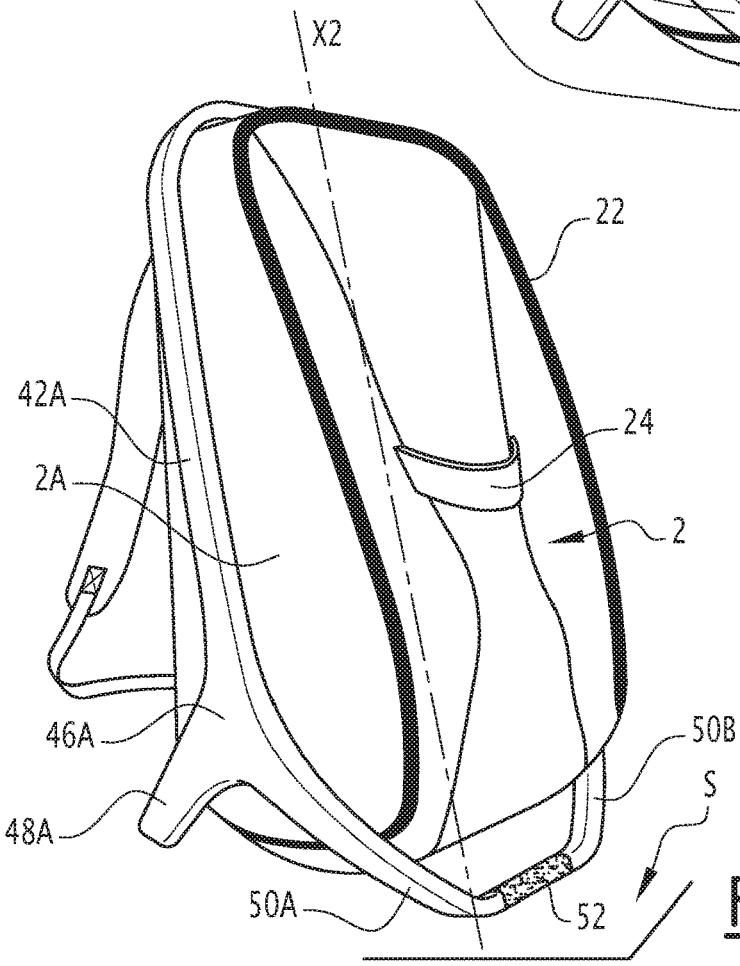
FIG. 2 is a perspective view of the same sport bag, without the tennis racket.
Figure 3:
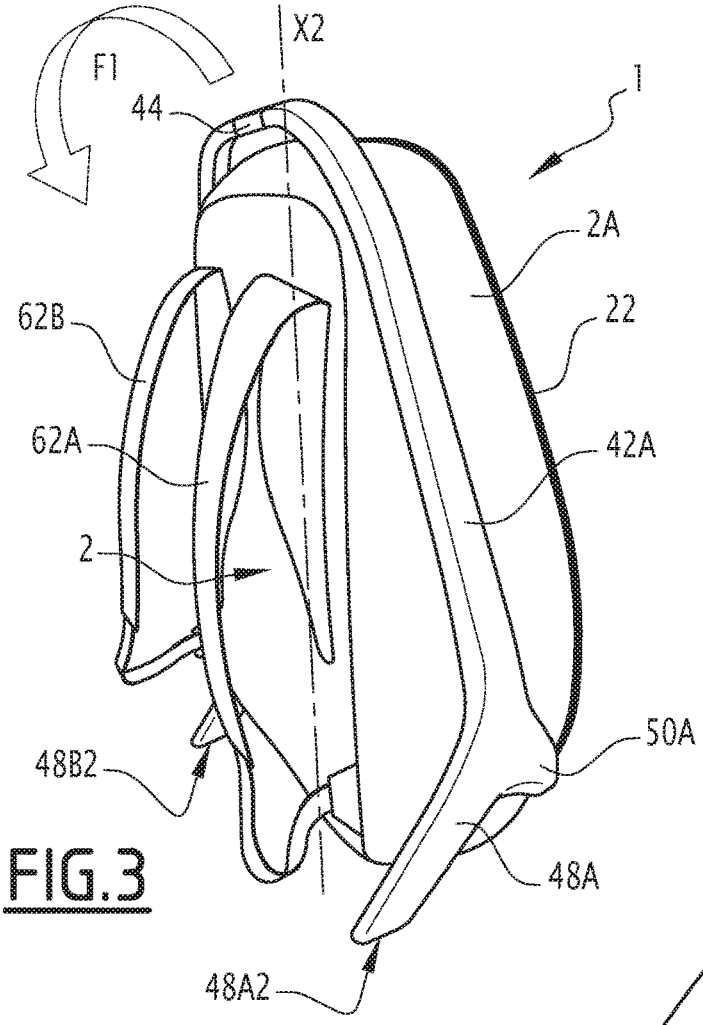
FIG. 3 is a perspective view, from another angle, of the same sport bag.
Figure 4:
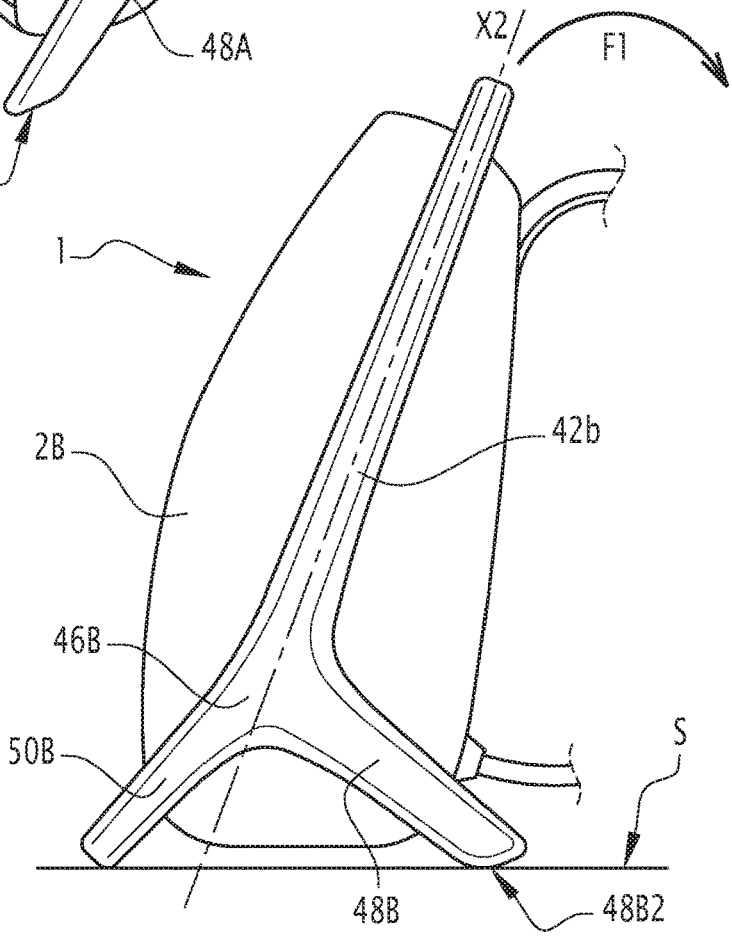
FIG. 4 is a side view of the bag of FIGS. 1 to 3.

It is also possible for him to lay the sport bag 1 down relative to the position shown in FIGS. 1 to 4 by tilting around an imaginary axis connecting the free ends 48A2 and 48B2 of the feet 48A and 48B and by bringing the bridge 44 closer to the support surface S, in the direction of the arrow F1 in FIGS. 3 and 4, until the bridge 44 is resting on the ground. In this second position of the bag 1 and the armature 4, which is not shown, the armature rests on the ground by the free ends 48A2 and 48B2 of the feet 48A and 48B and by the bridge 44. This second position is also stable because the number of bearing points of the armature 4 on the surface S, which are formed by the parts 48A2, 48B2 and 44, is greater than or equal to 3.

In this second position, the axis X2 is globally horizontal, i.e., horizontal to within 30°.

In this second position, it is possible to access the internal storage volume of the enclosure 2 by what is then the top of the sport bag 1, i.e., the rear part of the enclosure 2 visible in FIG. 2. One opens the zipper over a large travel, like a flexible suitcase, which makes it possible to move away the flap formed by the rear part of the flexible enclosure 2. The access to the inside of the enclosure is made easier.

The flexible enclosure 2 is equipped with straps 62A and 62B that allow a user U to carry the bag on his back. Relative to the forks 46A and 46B, the straps 62A and 62B are on the same side as the feet 48A and 48B. Thus, when the user carries the bag 1 on his back, the feet 48A and 48B are located on either side of his hips, without bothering him.

The tabs 50A and 50B and the pad 52 are located behind his back or his buttocks, without bothering him.

Also in this second position, the armature keeps the flexible enclosure 2 at a distance above the support surface S. Only the straps 62A and 62B can drag on the surface S.

Figure 5:
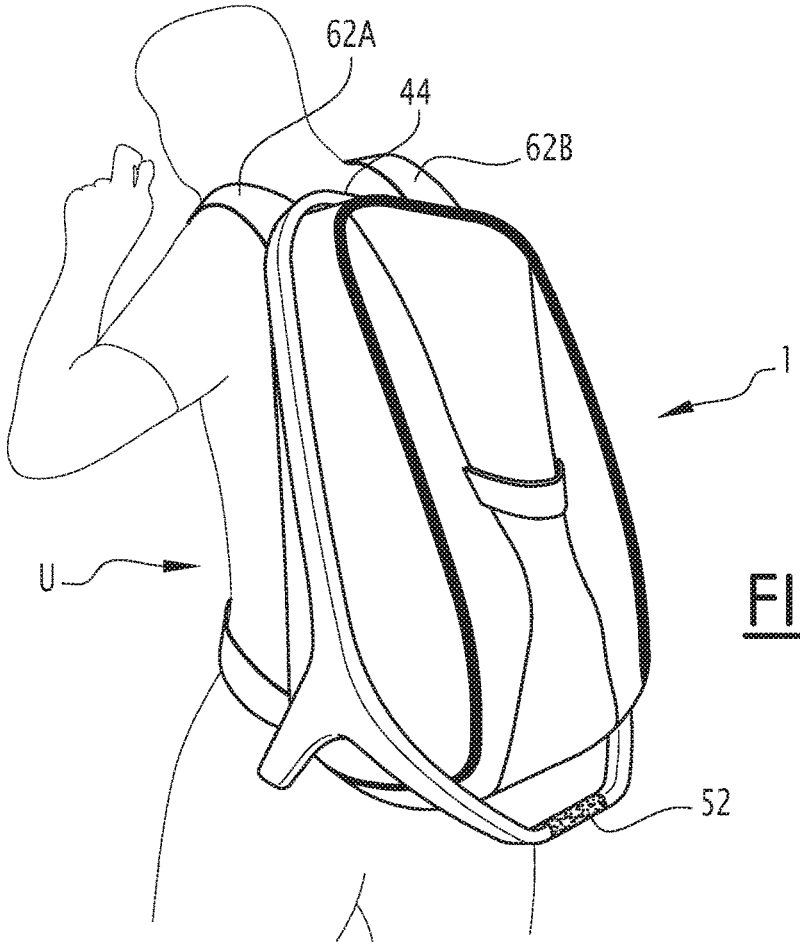
FIG. 5 is a schematic rear illustration of a user in the process of carrying the bag of FIGS. 1 to 4.

According to an optional aspect of the invention shown only in FIG. 5, the sport bag 1 is equipped with a belt 64.

According to another optional aspect of the invention, the flexible enclosure 2 bears, on its back side visible in FIGS.

1 and 2, a loop 24 that forms a retaining member for a racket 6 on the outside of the flexible enclosure 2. This makes it possible to transport the racket 6 without having to open the zipper to store the racket 6 inside the flexible enclosure 2.

In a variant of the invention that is not shown, the flexible enclosure 2 can be equipped with external pockets.

Advantageously, the bridge 44 and/or the pad 52 is configured as a gripping handle for the sport bag 1. One or the other of these members can be covered by a layer of elastomer.

According to another variant of the invention that is not shown, the number of bearing points of the armature 4 on the support surface S can be greater than or equal to 4 in one of the first and second positions of this armature, or in both of these positions. Thus for example, the tabs 50A and 50B may not come together at the tab 52. In this case, the number of bearing points is 4 in the first position of the armature 4.

In a variant, the sport bag 1 is not a tennis bag, but a bag intended for practicing another sport, for example badminton, paddleball or climbing.

The embodiment and variants considered above can be combined.

The invention claimed is:

1. A sport bag comprising:

a flexible enclosure delimiting an equipment storage space, a rigid armature, attached to the flexible enclosure, the rigid armature arranged outside the flexible enclosure and provided to rest on a support surface in two different positions, namely a first position, in which the armature rests on the support surface by at least three first bearing points, and a second position, in which the rigid armature rests on the bearing surface by at least three second bearing points, and wherein the three second bearing points are not all the same as the three first bearing points, and wherein each of the first bearing points is spaced apart from the remaining first bearing points by regions where the rigid armature does not rest on the support surface and each of the second bearing points is spaced apart from the remaining second bearing points by regions where the rigid armature does not rest on the support surface wherein, the rigid armature comprises two lateral uprights, a bridge, and a bearing pad, the bridge connecting first ends of the two lateral uprights together, each lateral upright is positioned along one side of the flexible enclosure and the bridge is positioned outside a top of the flexible enclosure, each lateral upright ends with a fork that splits into two ends, a first of the two ends terminated with a foot and a second of the two ends ending in a tab connected to the bearing pad, each foot forms a different one of the first bearing points and the bearing pad forms a third one of the at least three first bearing points, and in the first position of the rigid armature, the bearing pad extends below the flexible enclosure, at a distance therefrom.

2. The sport bag according to claim 1, wherein, in at least the first position, the rigid armature keeps the flexible enclosure at a distance from the support surface.

3. The sport bag according to claim 2, wherein the rigid armature keeps the flexible enclosure at a distance from the support surface in both of the first and second positions.

4. The sport bag according to claim 1, further comprising straps allowing a user to carry the sport bag on their back and wherein the feet extend, from the forks, on the same side of the uprights as the straps.

5. The sport bag according to claim 1, wherein at least one of the three second bearing points is or are the same as one or some of the three first bearing points.

6. The sport bag according to claim 5, wherein two of the three second bearing points are the same as some of the three first bearing points.

7. The sport bag according to claim 1, wherein the rigid armature is made from synthetic material.

8. The sport bag according to claim 1, wherein the rigid armature is manufactured by assembly, at the pad and the bridge, of two parts respectively forming its left and right sides.

9. The sport bag according to claim 1, wherein the rigid armature is a monobloc.

10. The sport bag according to claim 1, wherein the rigid armature is made from thermoplastic.

11. The sport bag according to claim 1, wherein the rigid armature is made from metal.

12. The sport bag according to claim 1, wherein the rigid armature is made from composite material wood.

13. The sport bag according to claim 1, wherein the rigid armature is made from wood.

14. A sport bag comprising:

a flexible enclosure delimiting an equipment storage space, a rigid armature, attached to the flexible enclosure, the rigid armature arranged outside the flexible enclosure and provided to rest on a support surface in two different positions, namely a first position, in which the rigid armature rests on the support surface by at least three first bearing points, and a second position, in which the rigid armature rests on the bearing surface by at least three second bearing points, and wherein the three second bearing points are not all the same as the three first bearing points, and wherein each of the first bearing points is spaced apart from the remaining first bearing points by regions where the rigid armature does not rest on the support surface and each of the second bearing points is spaced apart from the remaining second bearing points by regions where the rigid armature does not rest on the support surface, wherein, the rigid armature comprises two lateral uprights, a bridge, and a bearing pad, the bridge connecting first ends of the two lateral uprights together, the bridge forms one of the three second bearing points, in the first position of the rigid armature, the bearing pad extends below the flexible enclosure, at a distance therefrom, each lateral upright is positioned along one side of the flexible enclosure and the bridge is positioned outside a top of the flexible enclosure, each lateral upright ends with a fork that splits into two ends, a first of the two ends terminated with a foot and a second of the two ends ending in a tab connected to the bearing pad, each foot forms a different one of the first bearing points and the bearing pad forms a third one of the at least three first bearing points.

15. The sport bag according to claim 14, wherein, the lateral uprights, the bridge, the tabs, and the bearing pad form a closed ring, the flexible enclosure being mounted within the closed ring.

* * * * *